United States Patent [19]

Raleigh

[11] 4,031,979

[45] June 28, 1977

[54] ADJUSTABLE MUFFLER FOR MODEL AIRCRAFT TYPE ENGINES

[76] Inventor: Roger W. Raleigh, 530 Alsace Lorraine, Half Moon Bay, Calif. 94019

[22] Filed: Apr. 24, 1975

[21] Appl. No.: 571,374

[52] U.S. Cl. ..... 181/69; 181/40; 181/57

[51] Int. Cl.[2] ..... F01N 1/00

[58] Field of Search ..... 181/40, 69, 57, 50, 181/36 A, 35 R

[56] References Cited

UNITED STATES PATENTS

| | | | |
|---|---|---|---|
| 2,795,103 | 6/1957 | Jenison | 181/69 |
| 3,434,280 | 3/1969 | Burkhart | 181/40 |
| 3,545,566 | 12/1970 | Abrahamsson | 181/69 |
| 3,842,932 | 10/1974 | Gibel | 181/69 |

*Primary Examiner*—Stephen J. Tomsky
*Attorney, Agent, or Firm*—Lowhurst & Aine

[57] ABSTRACT

In a muffler for a two-cycle combustion engine of the type commonly used to power miniature aircraft, cars, boats and models, the exhaust gas is directed into an expansion chamber for expansion and cooling, thence through a series of spaced baffles in a baffle chamber, and thence through a nozzle to the atmosphere. The baffle plates may comprise one or more different types having different sonic wave reflective characteristics and different impedances to gas flow. The baffle plates are spaced apart by one or more of a number of spacers providing different axial spacing between the baffle plates. THe baffle plates and their spacings are chosen by the user so as to obtain the required degree of muffling with the least amount of back pressure on the engine, as back pressure reduces engine power. The user is supplied with a kit having the various different type baffles and spacers. The user selects from the kit the desired spacers and baffles in accordance with his own experiments or in accordance with experimental data supplied by the manufacture of the kit. The nozzle includes a threaded end for mating with the threaded interior of the baffle chamber so that by removing the nozzle the baffles and the spacers may be stacked in the baffle chamber in the desired configuration and the nozzle replaced for securely holding the baffles in the desired geometry.

10 Claims, 15 Drawing Figures

11
12
13
14
15
16
17
18
19
21
22
23
25
26
27
29
31
33
35
2B
3B
4B
5B
6B
7B,C,D

ADJUSTABLE MUFFLER FOR MODEL AIRCRAFT TYPE ENGINES

BACKGROUND OF THE INVENTION

The present invention relates in general to mufflers for muffling model aircraft type engines and more particularly to an adjustable muffler which can be adjusted for balancing a desired degree of muffling versus the least power loss to the engine.

DESCRIPTION OF THE PRIOR ART

Heretofore, adjustable mufflers for model aircraft type engines have been proposed wherein the number of, and the spacing between, a stack of diffuser plates was adjustable for the purpose of obtaining the desired degree of muffling. In this prior system the exhaust gases exited from the muffler through spaces between the diffuser plates at the peripheries thereof. The stack of diffuser plates was closed at its end so that all of the exhaust gases were caused to flow out of the muffler through the spaces between adjacent diffuser plates. Such a muffler is disclosed in U.S. Pat. No. 3,779,342 issued Dec. 18, 1973.

While the aforecited model airplane engine muffler provides a certain degree of adjustability to permit its use on a number of different types of engines, it is desired to obtain a muffler which can be more exactly tailored to the requirements of a particular engine and which will be more efficient in its muffling action so as to reduce the loss of power to the engine for any given degree of muffling.

SUMMARY OF THE PRESENT INVENTION

The principal object of the present invention is the provision of an improved adjustable muffler for model aircraft type engines.

In one feature of the present invention, the muffler includes an expansion chamber into which the exhaust gases of the engine are fed, for expansion and cooling, and thence through a series of muffling elements to the atmosphere.

In another feature of the present invention, a restrictive nozzle is provided downstream of the baffling elements for reflecting acoustic wave energy without substantially restricting the flow of exhaust gases through the muffler elements.

In another feature of the present invention, the baffle chamber includes therein a number of spaced baffle members spaced apart by spacers of variable lengths for providing variable spacings between adjacent baffle members.

In another feature of the present invention the baffle chamber includes a plurality of different types of baffle means having a different sonic wave reflective characteristic and presenting different impedances to exhaust gas flow therethrough, whereby the muffling characteristics can be matched more closely to a particular engine for optimum muffler performance versus loss of power to the engine.

Other features and advantages of the present invention will become apparent upon a perusal of the following specification taken in connection with the accompanying drawings wherein:

BRIEF DESCRIPTION OF THE DRAWINGS

FIG. 1 is a side elevational perspective view, partially exploded, and partially cut away, showing the muffler of the present invention as mounted to a two-cycle model aircraft type engine, FIGS. 2A–6A are plan views of various baffles to be utilized in the muffler of FIG. 1, FIGS. 2B–6B are sectional views of the respective FIGS. 2A–6A, FIG. 7A is an end view of a spacer to be incorporated between baffle plates in the muffler of FIG. 1 and FIGS. 7B–7D are sectional views of the spacer of FIG. 7A taken along lines B, C, and D, respectively, in the direction of the arrows.

DESCRIPTION OF THE PREFERRED EMBODIMENTS

Figures 1, 2A, 2B, 3A, 3B, 4A, 4B, 5A, 5B, 6A, 6B, 7A, 7B, 7C, 7D:
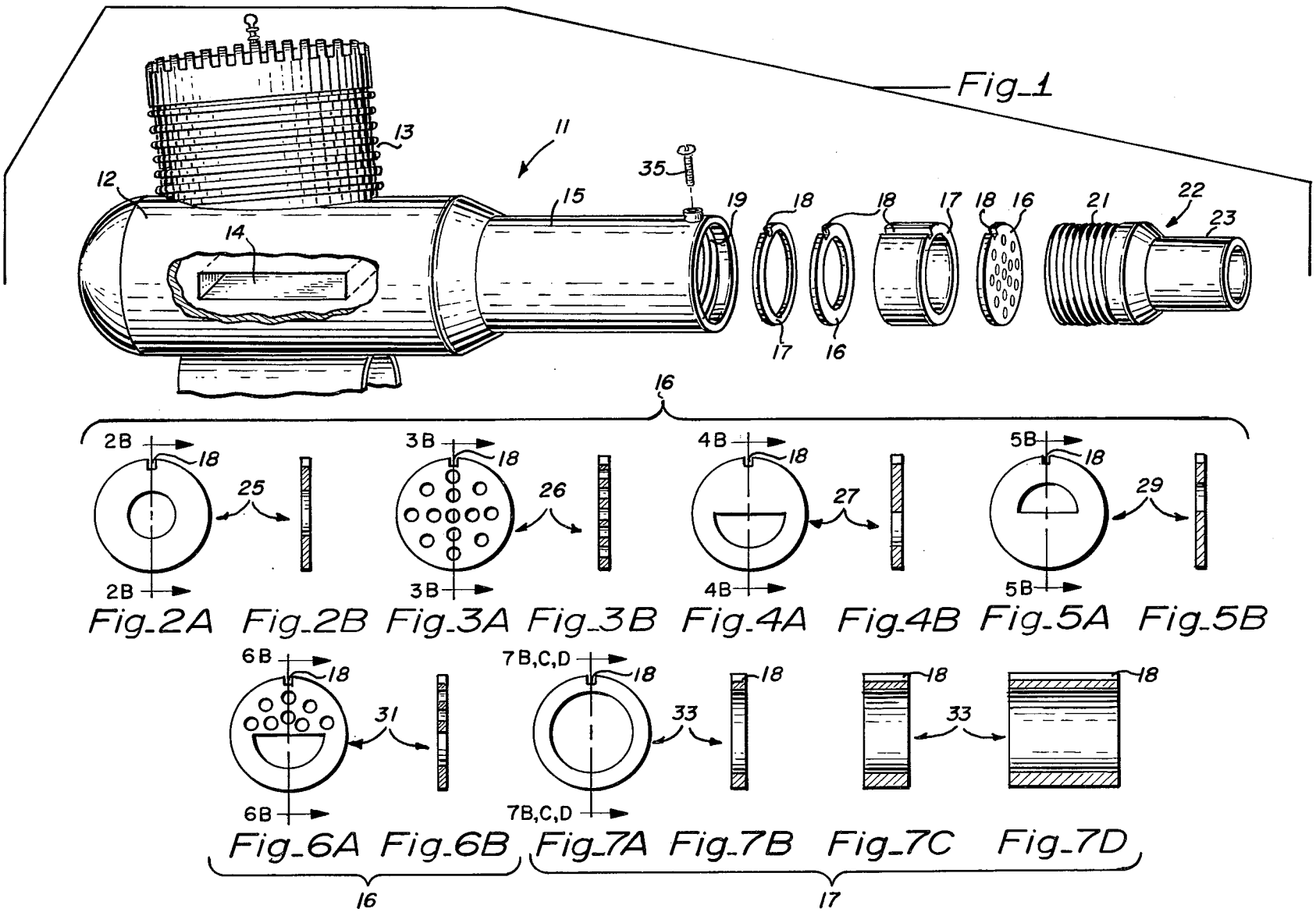

Referring now to FIG. 1 there is shown a muffler 11 of the present invention. The muffler includes an expansion chamber 12 coupled to the exhaust port of an engine 13 to be muffled. Typically, the engine 13 to be muffled is of the model aircraft type, i.e., a two-cycle internal combustion engine capable of operating at relatively high speed, as of 8,600–20,000 rpm. Such engines are commonly utilized for powering miniature aircraft, cars, boats, and models. The expansion chamber 12 includes an outwardly directed tubular connecting portion 14 which is secured in alignment with the exhaust port of the engine 13 via conventional means such as screws, straps or the like.

The hot exhaust gases from the engine 13 are fed into the expansion chamber 12 having a volume at least three times the displacement volume of the engine and preferably approximately ten times the displacement volume on the engine, such that substantial cooling of the exhaust gas is obtained by the expansion of the gas in the expansion chamber 12. The cooled exhaust gases exit the expansion chamber 12 and are directed into and through a baffle chamber 15. Baffle chamber 15 includes a plurality of transverse baffle plates spaced apart in the direction of the flow of exhaust gas by means of tubular spacers 17. The various different type baffle plates and spacers are shown in greater detail below with regard to FIGS. 2–7.

Each of the baffle plates and baffles includes a key slot 18 to receive a key, not shown, contained within the bore of the baffle chamber 15. The end of the baffle chamber is internally threaded at 19 to receive the external threads 21 of a tail pipe 22 which includes an exhaust nozzle 23 of reduced cross-sectional area dimensioned so as to substantially restrict the flow of cooled exhaust gases therethrough and to produce a consequent reflected sonic wave on the baffle chamber 15 and on the expansion chamber 12 to further bottle-up the noise in the muffler 11.

The baffle plates are selected from among a number of different types of baffle plates having different sonic wave reflective characteristics and impedances to the flow of exhaust gases therethrough. The mode of operation of the baffle chamber 15 is to produce sonic wave reflections which travel back up the exhaust stream to cancel or buck-out sonic waves produced by the engine 13 without producing an undue back pressure on the engine 13 which would otherwise reduce the power output it could deliver to its load such as to a propeller or the like.

Since a substantial percentage of the engine noise is associatedwith the higher harmonics of the exhaust cycle, which fall within the high frequency end of the audio frequency range, the spacing and type of wave reflection produced by a given baffle becomes important and can vary with the rpm of the engine. Moreover, the maximum noise that can be produced by the engine can vary from time to time depending upon the rules relative to noise output for certain competitive events. Generally, the muffling effect and the back pressure effects on the engine vary inversely. That is, the more muffling desired the less power output delivered by the engine to the load. Thus, one chooses the baffles and spacing between the baffles to obtain the highest degree of mode suppression consistent with the minimum amount of engine power loss to achieve the desired degree of muffling. In most cases, this optimum selection of the muffling baffles and their spacing is determined empirically for a given engine and desired output power.

Thus, in the present invention, a kit of a number of different types of baffles 16 is supplied to the user together with a number of different spacers 18 for providing different spacing between the baffles.

A set of typical baffles is shown in FIGS. 2A–6A. More particularly, a first baffle is shown in FIGS. 2A and 2B wherein the baffle 16 comprises a centrally apertured or toroidal plate 25. A second type of baffle plate is shown in FIGS. 3A and 3B and comprises a perforated plate 26. This plate has relatively high impedance to flow of exhaust gases therethrough and provides nearly total sonic wave reflection therefrom. A third type of wave reflective baffle plate 27 is shown in FIGS. 4A and 4B and is similar to the toroidal baffle plate 25 of FIGS. 2A and 2B except that the central aperture comprises only half of a circular aperture, namely, a half-moon shaped aperture 28 provided in the lower half of the plate 27.

The counterpart to the baffle plate 4A and 4B is shown in FIGS. 5A and 5B and comprises a half-moon shaped opening in the baffle plate 29 such opening being in the upper half of the plate. Series of baffle plates of FIGS. 4 and 5 alternating through a stack of baffle plates causes the exhaust gas to flow along a tortuous path oscillating back and forth across the center line of the muffler.

The baffle plate 31 of FIGS. 6A and 6B comprises a combination of perforated baffle plate 26 and the half toroidal baffle plate 27 of FIGS. 4A and 4B. Baffle plate 31 provides substantial wave reflection while offering less impedance to exhaust flow than either the half baffle plates of FIGS. 4 and 5 or the perforated plate of FIG. 3.

Referring now to FIG. 7 there is shown a spacer ring 33 having different axial lengths for providing different axial spacings between adjacent baffle members or plates 16.

Due to the different noise muffling requirements for different competitive sporting events employing model aircraft engines, such as model airplane races, model airplane stunting, boat races and the like, it is often necessary for the competitive user to find the optimum type and spacing between baffles for a given degree of noise suppression while achieving maximum output power at that noise level. Since the acceptable noise level, say at twenty feet from the engine, can vary from one event to another and from one place to another due to different local ordinances, it is desirable for the user to be able to select an optimum combination of baffle types and spacings to achieve the required degree of noise suppression or muffling while achieving maximum power output.

Therefore, the user is supplied with a kit having several different types of baffle plates 16 such as shown in FIGS. 2–6 and several different types of spacers 17 as shown in FIG. 7. The user then from a predetermined chart for the given engine type and rpm or from his own experimental data chooses what he believes to be an optimum combination of baffle plates 16 and spacers 17 to achieve optimum power output for a given amount of noise suppression. He then assembles these baffle plates and spacers into the baffle chamber in the certain predetermined stacked array and then threadably inserts the tail pipe 22 so as to tighten down on the stack of baffle plates 16 and spacers 17. Once the tail pipe is threaded into place a set screw 35 is inserted for holding the tail pipe in position, which in turn, holds the baffle structure in place.

Referring now to Table I there is shown the muffling effect obtained by the use of muffler 11 of the present invention for muffling different engines having different displacements. The noise db was measured at twenty feet downwind of the engine. In each instance, the engine was turning at the same rpm with the given prop or load.

TABLE I

| HIGHEST DB READING 20' DOWNWIND, ENGINE ROTATED | | | | | |
|---|---|---|---|---|---|
| ENGINE | WITHOUT MUFFLER | 4 TOROIDAL | 2 PERFORATED | 6 TOROIDAL | PROP |
| McCoy .40 Series 21 | 95 db | 88 db | 83 db | 84 db | 11" × 4"p |
| Enya .15 | 87 db | 84 db | 78 db | 80 db | 7" × 6"p |
| Fox .35 | 92 db | 86 db | 80 db | 83 db | 11" × 4"p |
| McCoy .19 Series 21 | 91 db | 87 db | 79 db | 80 db | 8" × 6"p |

In a typical example of one of the engines of the Table above, for example the Fox stunt engine having 0.35 cubic inch displacement, the engine was turning at 9400 rpm producing 92 db of noise at twenty feet without a muffler. With muffler 11 installed having four toroidal baffles 25 with spacings between the baffles of 0.250inch the noise level was reduced to 86 db. When two perforated plates 26 were employed with spacings between the baffles of 0.75 inch the noise level was reduced to 80 db. When six toroidal baffles were employed with spacings therebetween of 0.25 inch, 0.25 inch, 0.125 inch, 0.125 inch and 0.062 inch, respectively, the noise was reduced to 83 db.

What is claimed is:

1. In a muffler for muffling the exhaust of a two-cycle combustion engine of the type commonly used to power miniature aircraft, cars, boats and models:

baffle chamber means adapted to be connected in gas communication with and downstream of the exhaust port of the combustion engine for flow therethrough of the exhaust gases as fed into said baffle chamber means from the engine;

a plurality of baffle means adapted to be disposed in said baffle chamber means in spaced apart relation in the direction of the exhaust gas flow therethrough for providing different sonic wave reflections from each of said baffle means for reflecting sonic waves in the exhaust stream back to the engine for muffling the flow of the exhaust flow therethrough; and nozzle means having lesser cross-sectional dimensions for the flow of exhaust gas therethrough than those of said baffle chamber means so as to produce a sonic wave reflection in said baffle chamber and adapted to be connected in exhaust gas communication with and downstream of said baffle chamber means for reflecting sonic wave energy without substantially restricting the flow of exhaust gas therethrough for further muffling the flow of exhaust gas.

2. The apparatus of claim 1 including, a plurality of spacer means adapted for disposition within said baffle chamber for providing different spacings between adjacent spaced apart baffle means depending upon the selection of said spacer means to be employed between adjacent baffle means.

3. The apparatus of claim 2 wherein said baffle means comprises a plurality of different types of baffle means each type having different sonic wave reflection characteristics and presenting different impedances to exhaust gas flow so that the wave reflective characteristics and back pressure of the baffle means are controlled depending upon the selection of the respective baffle means to be disposed within said baffle chamber.

4. In a method for muffling the exhaust of a two-cycle combustion engine of the type commonly used to power miniature aircraft, cars, boats and models, the steps of:

expanding the exhaust gas derived from the exhaust port of the engine into an expansion chamber having a volume at least three times that of the displacement of the engine for cooling of the exhaust gas;

thence feeding the expanded and cooled exhaust gas through a baffle chamber having a plurality of sonic wave reflective baffles spaced apart along the direction of exhaust flow through the baffle chamber; and constricting the flow of exhaust gases exiting from the downstream end of the baffle chamber so as to provide a reflection of sonic wave energy producing a substantial back pressure upon the baffle chamber and engine.

5. The method of claim 4 including the step of, arranging the spacing between adjacent baffles from a number of different predetermined spacings to obtain optimum engine power for a given amount of muffling of the particular engine being muffled.

6. The method of claim 4 including the steps of, selecting and arranging the baffles within the baffle chamber from a number of different predetermined baffles having different sonic wave reflective characteristics to obtain optimum engine power for a given amount of muffling of the particular engine being muffled.

7. In a muffler for muffling the exhaust of a two-cycle combustion engine of the type commonly used to power miniature aircraft, cars, boats and models:

a tubular expansion chamber having a port therein for exhaust gas communication with the exhaust port of the engine to be muffled for feeding of the exhaust gases of the engine into said expansion chamber for expansion and cooling of the exhaust gas therein;

a tubular baffle chamber connected in gas communication with said expansion chamber downstream thereof, said baffle chamber having cross-sectional dimensions to present higher impedance to the flow of exhaust gas therethrough than that presented by said expansion chamber;

a plurality of baffle members disposed within said baffle chamber in spaced apart relation taken in the direction of exhaust gas flow therethrough for reflecting sonic waves in the exhaust stream back to the engine for muffling the flow of exhaust gas therethrough; and a tail pipe having lesser cross-sectional dimensions for the flow of exhaust gas therethrough than those of said baffle chamber so as to produce a sonic wave reflection on said baffle chamber, said tail pipe having a coupling portion for mating with a coupling portion of said baffle chamber for coupling said tail pipe to said baffle chamber.

8. The apparatus of claim 7 including, a plurality of spacer means adapted for disposition within said baffle chamber for providing different spacing between adjacent spaced apart baffle members depending upon the selection of the length of said spacer means to be employed between adjacent baffle members.

9. The apparatus of claim 8 wherein said spaced apart baffle means comprise a plurality of different types of baffle means each type having different sonic wave reflective characteristics and presenting different impedances to exhaust gas flow than the others so that the sonic wave reflection characteristics and back pressure of said baffles are controlled depending upon the selection of the respective baffle members to be disposed within said baffle chamber.

10. The apparatus of claim 9 including in combination a two-cycle combustion engine of the type commonly used to power miniature aircraft, cars, boats and models, and wherein said expansion chamber means is connected in gas communication with the exhaust port of said combustion engine for receiving the exhaust gases therefrom.

* * * * *